US007663567B2

(12) United States Patent
Hilgers

(10) Patent No.: US 7,663,567 B2
(45) Date of Patent: Feb. 16, 2010

(54) ANTENNA STRUCTURE, TRANSPONDER AND METHOD OF MANUFACTURING AN ANTENNA STRUCTURE

(75) Inventor: Achim Hilgers, Alsdorf (DE)

(73) Assignee: NXP B.V., Eindhoven (NL)

( * ) Notice: Subject to any disclaimer, the term of this patent is extended or adjusted under 35 U.S.C. 154(b) by 43 days.

(21) Appl. No.: 11/996,866

(22) PCT Filed: Aug. 1, 2006

(86) PCT No.: PCT/IB2006/052617

§ 371 (c)(1),
(2), (4) Date: Jan. 25, 2008

(87) PCT Pub. No.: WO2007/015205

PCT Pub. Date: Feb. 8, 2007

(65) Prior Publication Data

US 2008/0316135 A1 Dec. 25, 2008

(30) Foreign Application Priority Data

Aug. 2, 2005 (EP) ..... 05107125

(51) Int. Cl.
*H01Q 9/28* (2006.01)

(52) U.S. Cl. ..... 343/795; 343/803

(58) Field of Classification Search ..... 343/700 MS, 343/795, 803; 340/572.1, 572.7; 235/492
See application file for complete search history.

(56) References Cited

U.S. PATENT DOCUMENTS

| | | | | |
|---|---|---|---|---|
| 6,002,371 | A * | 12/1999 | Mittler et al. | 343/702 |
| 7,055,754 | B2 * | 6/2006 | Forster | 235/492 |
| 7,460,015 | B2 * | 12/2008 | Forster et al. | 340/572.3 |
| 2005/0024287 | A1 | 2/2005 | Jo et al. | |
| 2006/0061515 | A1 * | 3/2006 | Posluszny et al. | 343/803 |
| 2006/0208955 | A1 * | 9/2006 | Kai et al. | 343/795 |
| 2008/0186245 | A1 * | 8/2008 | Hilgers | 343/803 |
| 2008/0266191 | A1 * | 10/2008 | Hilgers | 343/726 |

FOREIGN PATENT DOCUMENTS

| | | | |
|---|---|---|---|
| AU | 698056 | B2 | 10/1998 |
| WO | 2003044892 | A1 | 5/2003 |
| WO | 2004093249 | A1 | 10/2004 |
| WO | 2005048476 | A1 | 5/2005 |

* cited by examiner

*Primary Examiner*—Tan Ho

(57) ABSTRACT

An antenna structure (106) comprising a first electrically conductive element (102) having a first end and a second end, a second electrically conductive element (103) having a first end and a second end, and a coupling structure (104) short-circuiting the first electrically conductive element (102) with the second electrically conductive element (103) by means of electrically connecting the electrically conductive elements (102, 103) at positions between the first and the second ends, wherein an integrated circuit (105) is connectable between the first end of the first electrically conductive element (102) and the first end of the second electrically conductive element (103).

11 Claims, 7 Drawing Sheets

ANTENNA STRUCTURE, TRANSPONDER AND METHOD OF MANUFACTURING AN ANTENNA STRUCTURE

FIELD OF THE INVENTION

The invention relates to an antenna structure.

Moreover, the invention relates to a transponder.

Finally, the invention relates to a method of manufacturing an antenna structure.

BACKGROUND OF THE INVENTION

The importance of automatic identification systems increases particularly in the service sector, in the field of logistics, in the field of commerce and in the field of industrial production. Thus, automatic identification systems are implemented more and more in these and other fields and will probably substitute barcode systems in the future. Further applications of identification systems are related to the identification of persons and animals.

In particular contactless identification systems, like transponder systems for instance, are suitable for a wireless transmission of data in a fast manner and without cable connections that may be disturbing. Such systems use the emission and absorption of electromagnetic waves, particularly in the high frequency domain. Systems having an operation frequency below approximately 800 MHz are frequently based on an inductive coupling of coils, which are brought in a resonance state by means of capacitors, and which are thus only suitable for a communication across small distances of up to one meter.

Due to physical boundary conditions, transponder systems having an operation frequency of 800 MHz and more are particularly suitable for a data transfer across a distance of some meters. These systems are the so-called long-range RFID-systems ("radio frequency identification"). Two types of RFID-systems are distinguished, namely active RFID-systems (having their own power supply device included, for example a battery) and passive RFID-systems (in which the power supply is realized on the basis of electromagnetic waves absorbed by an antenna, wherein a resulting alternating current in the antenna is rectified by a rectifying subcircuit included in the RFID-system to generate a direct current). Moreover, semi-active (semi-passive) systems which are passively activated and in which a battery is used on demand (e.g. for transmitting data) are available.

A transponder or RFID tag comprises a semiconductor chip (having an integrated circuit) in which data may be programmed and rewritten, and a high frequency antenna matched to an operation frequency band used (for example a frequency band of 902 MHz to 928 MHz in the United States, a frequency band of 863 MHz to 868 MHz in Europe, or other ISM-bands ("industrial scientific medical"), for instance 2.4 GHz to 2.83 GHz). Besides the RFID tag, an RFID-system comprises a reading device and a system antenna enabling a bi-directional wireless data communication between the RFID tag and the reading device. Additionally, an input/output device (e.g. a computer) may be used to control the reader device.

The semiconductor chip (IC, integrated circuit) is directly coupled (e.g. by wire-bonding, flip-chip packaging) or mounted as a SMD ("surface mounted device") device (e.g. TSSOP cases, "thin shrink small outline package") to a high frequency antenna. The semiconductor chip and the high frequency antenna are provided on a carrier substrate that may be made of plastics material. The system may also be manufactured on a printed circuit board (PCB).

In order to increase the efficiency of such a transponder, an efficient antenna should be used. Further, the reflection of energy between the antenna and the semiconductor chip should be as low as possible. This may be accomplished by matching the electromagnetic properties of the semiconductor chip and the electromagnetic properties of the antenna. A maximum amount of power may be transmitted, if the value of the impedance of the semiconductor chip $\underline{Z}_{chip}$ is complex conjugate to the value of the impedance of the antenna $\underline{Z}_{ant}$:

$$\underline{Z}_{chip}=\underline{Z}_{ant} \tag{1}$$

$$R_{chip}+jX_{chip}=R_{ant}-jX_{ant} \tag{2}$$

In equation (2), $R_{chip}$ denotes the ohmic resistance of the semiconductor chip, j is the imaginary number, and $X_{chip}$ is the (inductive or capacitive) reactance of the semiconductor chip. $R_{ant}$ is denoted the ohmic resistance of the antenna, and $X_{ant}$ is the (inductive or capacitive) reactance of the antenna.

As can be seen from equations (1) and (2), for an appropriate impedance matching, the absolute values of the real parts of the complex impedances of the semiconductor chip and of the antenna should be equal, and the absolute values of the imaginary parts of the complex impedances should be identical, wherein the reactance of the semiconductor chip should be complex conjugate to the reactance of the antenna.

According to the manufacturing process of a semiconductor chip, the impedance of a semiconductor chip is usually dominated by the capacitive contribution, i.e. the imaginary part $X_{chip}$ is usually negative. Consequently, for an efficient transponder antenna design, the reactance of the antenna should be dominated by the inductive contribution, i.e. the reactance $X_{ant}$ should be positive, and its absolute value should be equal to the imaginary part of the impedance of the semiconductor chip. If this is the case, and if the condition is fulfilled that the two real parts $R_{chip}$ and $R_{ant}$ are equal, then an efficient power matching is realized and a high energy transfer between the semiconductor chip and the antenna can be obtained. Thus, for an efficient antenna design, the real part and the imaginary part of the impedance of the antenna should be matched to a given impedance of a semiconductor chip.

OBJECT AND SUMMARY OF THE INVENTION

It is now an object of the invention to provide an antenna structure allowing for a broadband operation.

In order to achieve the object defined above, an antenna structure, a transponder and a method of manufacturing an antenna structure according to the independent claims are provided.

According to an exemplary embodiment of the invention, an antenna structure is provided comprising a first electrically conductive element having a first end and a second end, a second electrically conductive element having a first end and a second end, and a coupling structure short-circuiting the first electrically conductive element with the second electrically conductive element by means of electrically connecting the electrically conductive elements at positions between the first and the second ends, wherein an integrated circuit may be connectable between the first end of the first electrically conductive element and the first end of the second electrically conductive element.

According to another exemplary embodiment of the invention, a transponder is provided which comprises a substrate, an antenna structure having the above-mentioned features and arranged on and/or in the substrate, and an integrated circuit connected between the first end of the first electrically conductive element and the first end of the second electrically conductive element.

According to still another exemplary embodiment of the invention, a method of manufacturing an antenna structure is provided which comprises the steps of providing a first electrically conductive element having a first end and a second end, providing a second electrically conductive element having a first end and a second end, short-circuiting the first electrically conductive element with the second electrically conductive element by means of electrically connecting the electrically conductive elements at positions between the first and the second ends by means of a coupling structure, and adapting the electrically conductive elements in such a manner that an integrated circuit is connectable between the first end of the first electrically conductive element and the first end of the second electrically conductive element.

The characterizing features according to the invention particularly have the advantage that an antenna structure is provided which is particularly appropriate for use in an RFID transponder ("radio frequency identification tag"), since it can be flexibly operated in a broad range of operation frequencies. This advantage particularly results from the provision of a coupling structure short-circuiting two electrically conductive elements of the antenna structure. By flexibly selecting the position and/or the geometrical properties of such a short-circuit and/or its relation to the properties of the electrically conductive elements, the broadband functionality can be obtained.

One exemplary embodiment of the invention relates to an antenna configuration suited for RFID applications, particularly in the frequency range above 800 MHz. This tag or antenna design shows a broadband impedance matching to a given transponder chip. Hence, the tag/antenna structure according to an exemplary embodiment of the invention is robust against changes of the boundary conditions in the near field of the transponder.

The input impedance of an antenna, among others, depends on the direct coupling in the near field region of the antenna itself. In other words, when the direct near field region of the antenna is modified (for instance by other objects being present in this region), then this has a feedback to the input impedance of the antenna such that the resonance frequency of the antenna is shifted, thus influencing the entire performance of a transponder comprising such an antenna. Particularly, narrow band antenna or transponder configurations have significant disadvantages compared to broadband solutions.

In the light of the foregoing considerations, one exemplary embodiment of the present invention is related to a transponder or antenna design, which is relatively robust with respect to changes in the environmental properties in the direct near field region of the antenna. By a broadband adjustment to a given chip impedance, shifts in the resonant frequency of the antenna do not have a negative influence on the functionality of the antenna.

One embodiment of the invention is thus related to an antenna for RFID tags, particularly to a broadband RFID transponder. For this purpose, according to an exemplary embodiment of the invention, a folded dipole antenna having two conductors (preferably of different lengths) is provided, which conductors are short-circuited at a certain distance from the connection point of the antenna.

One desired property of said dipole antenna is a proper matching to the integrated circuit of the RFID tag as stated before. Therefore, said conductors are short-circuited at a predetermined distance from the connection point of the antenna. In addition, said conductors may be of different lengths. By variations of the geometric parameters of the two conductors, which furthermore may be parallel to each other, the impedance may be matched over a broad frequency range which may lead to high resistance of the RFID tag against environmental changes.

Circuiting the two electrically conductive elements may be realized as a DC short-circuit (that is to say a direct electrical connection), or as an AC short-circuit (that is to say by means of a capacitive coupling or an electrical disconnection).

A further adjustment parameter is the selection of dielectric material in the environment of the electrically conductive elements. By means of adjusting the electrical permittivity in the vicinity of the electrically conductive elements, the impedance of the antenna structure may be influenced, for instance to match the antenna's impedance to the chip's impedance. For this purpose, the material of a substrate may be selected accordingly. For instance, different portions of the substrate in or on which the electrically conductive elements are provided may be made of different dielectric material.

In order to adjust the material and/or the geometric parameters of the antenna structure for achieving impedance matching, a finite element analysis or any other numerical analysis may be performed.

Referring to the dependent claims, further exemplary embodiments of the invention will be described, which also apply for the transponder and for the method of manufacturing an antenna structure.

According to the antenna design of an exemplary embodiment of the invention, the second end of the first electrically conductive element and the second end of the second electrically conductive element may be disconnected. In other words, the first ends may be bridged or bridgeable by an integrated circuit (IC), and the other ends may be free from any electrical coupling.

The first electrically conductive element and the second electrically conductive element may be realized as essentially stripe-shaped elements being arranged essentially parallel to one another. Thus, the antenna structure may be formed by two parallel aligned wiring stripes which, at the one end, may be connected via the IC and, at their other ends, may be electrically isolated.

The first electrically conductive element and the second electrically conductive element may be realized as essentially stripe-shaped elements have different lengths. In other words, the extension of one of the two stripe-shaped electrically conductive elements may be larger than the other one. Such an asymmetric configuration in combination with a suitably selected arrangement of the coupling structure may support a proper impedance matching.

The coupling structure of the antenna structure may be adapted to ohmically couple the first electrically conductive element and the second electrically conductive element. In other words, the coupling structure may be an electrical connection between the two electrically conductive elements, which are thereby short-circuited for a direct current (DC). In other words, for a direct current, the coupling structure of this embodiment acts as a short-circuit.

Alternatively, the coupling structure may be adapted to capacitively couple the first electrically conductive element with the second electrically conductive element. According to this configuration, the coupling structure particularly acts as a short-circuit for high-frequency components of a current flowing through the antenna structure, thereby providing a short-circuit for an alternating current (AC).

Still referring to the described embodiment, the coupling structure may be realized by implementing a capacitor, that is to say by connecting a capacitor as a discrete electronic device between the two electrically conductive elements. Such a capacitor may, for instance, be realized as a surface mounted device (SMD).

Still referring to the embodiment in which the coupling structure is realized by a capacitive coupling element, the coupling structure may be realized as a plurality of metallization structures arranged at a distance from one another in a horizontal and/or vertical direction (with respect to a dielectric substrate). Particularly, the coupling structure may comprise two portions which overlap each other in such a manner that the overlapping part forms a capacity. According to the described embodiment, a vertical stack of layers is arranged in and/or on a substrate in the overlapping portion, wherein an intermediate layer between the overlapping parts may be made of a material with a sufficiently high value of the relative permittivity $\in_r$. This may yield an increase of the value of the capacity. A further increase of the value of the capacity may be accomplished by forming the intermediate layer such that it has a sufficiently small thickness.

Alternatively to the described embodiment, the metallization structures and the dielectric material may overlap in a plane parallel to a main surface of a substrate on which the antenna structure is formed. The main surface of the substrate may be defined as the surface of the substrate on which or in which the antenna structure is provided. Particularly, the disconnected portion may have the shape of a straight line or of a non-straight line like a meander, a spiral or the like. Any other geometric shape of the disconnected portion is possible. The larger the length of the disconnected portion, the higher is the resulting capacitor, the more pronounced is the capacitive coupling.

A meander-like structure can be obtained by providing the metallization structures as an interdigitated structure, e.g. having finger-shaped structures interlocking each other. A spiral-shaped connection region may be realized by providing end properties of the metallization structures with a spiral shape, wherein the two spirals thus created are embedded within each other.

According to another exemplary embodiment of the invention, the antenna structure may comprise dielectric material between different of the plurality of metallization structures. By taking this measure, the capacitive coupling of the device can be enhanced. The dielectric material may be a high-k material (e.g. aluminium oxide, $Al_2O_3$), that is to say a material with a high value of the electrical permittivity. The dielectric material may also be a ferroelectric material or a semiconductor material, that is to say material with an electrical conductivity that is less than a metallic conductivity.

The material and/or the dimensions of the electrically conductive elements may be configured such that the value of the impedance of the antenna structure essentially equals the complex conjugate of the impedance of the integrated circuit. By such an impedance matching, the power transfer between the integrated circuit and the antenna can be optimized. According to an embodiment of the invention, this impedance matching may be carried out by simply adjusting the dimensions of the antenna structure. This provides an integrated circuit design of a sufficient degree of freedom, and thus the parameters may be adjusted for an optimization of the impedance matching without the need of additional elements.

Particularly, the antenna structure may be realized as a folded dipole antenna. Such a folded dipole antenna may essentially have the form of two parallel aligned stripes of different lengths which are connected to some kind of U-shape via an integrated circuit.

In the following, exemplary embodiments of the transponder will be explained. However, these embodiments also apply for the antenna structure and for the method of manufacturing an antenna structure.

The transponder may be realized as a radio frequency identification tag (RFID) or as a smartcard.

An RFID tag may comprise a semiconductor chip (having an integrated circuit) in which data may be programmed and rewritten, and a high frequency antenna matched to an operation frequency band used (for example 13.56 MHz, or a frequency band of 902 MHz to 928 MHz in the United States, a frequency band of 863 MHz to 868 MHz in Europe, or other ISM-bands ("industrial scientific medical"), for instance 2.4 GHz to 2.83 GHz). Besides the RFID tag, an RFID-system may comprise a read/write device and a system antenna enabling a bi-directional wireless data communication between the RFID tag and the read/write device. Additionally, an input/output device (e.g. a computer) may be used to control the read/write device. Different types of RFID-systems are distinguished, namely active RFID-systems (having their own power supply device included, for example a battery) and passive RFID-systems (in which the power supply is realized on the basis of electromagnetic waves absorbed by a coil and an antenna, respectively, wherein a resulting alternating current in the antenna may be rectified by a rectifying sub-circuit included in the RFID-system to generate a direct current). Moreover, semi-active (semi-passive) systems which are passively activated and in which a battery is used on demand (e.g. for transmitting data) are available.

A smartcard or chipcard can be a tiny secure cryptoprocessor embedded within a credit card sized card or within an even smaller card, like a GSM card. A smartcard does usually not contain a battery, but power is supplied by a card reader/writer, that is to say by a read and/or write device for controlling the functionality of the smartcard by reading data from the smartcard or by writing data in the smartcard. A smartcard device is commonly used in the areas of finance, security access and transportation. Smartcards may contain high security processors that function as a secure storage means of data like cardholder data (for instance name, account numbers, number of collected loyalty points). Access to these data may be made only possible when the card is inserted to a read/write terminal.

Next, exemplary embodiments of the method of manufacturing an antenna structure will be described. However, these embodiments also apply for the antenna structure and for the transponder.

According to an exemplary embodiment of the method, the material and/or the dimensions of the electrically conductive elements may be configured such that the value of the impedance of the antenna structure essentially equals to the complex conjugate of the impedance of the integrated circuit. The term "impedance matching" particularly denotes a matching of the impedance of the integrated circuit to the impedance of the folded dipole antenna to optimize the energy transfer between the integrated circuit and the folded dipole antenna.

More particularly, the value of the impedance of the antenna structure may be made essentially equal to the complex conjugate of the impedance of the integrated circuit by adjusting the position at which the coupling structure connects the electrically conductive elements. The position of the short-circuiting between the two electrically conductive elements may significantly influence the impedance of the antenna structure and may thus serve as a sensitive parameter to adjust the impedance of the system.

Particularly, the first electrically conductive element and the second electrically conductive element may be realized as essentially stripe-shaped elements which are arranged essentially parallel to one another, and the value of the impedance of the antenna structure may be made essentially equal to the complex conjugate of the impedance of the integrated circuit by adjusting at least one of the parameters of the group consisting of the width of at least one of the electrically conductive elements and the coupling structure, the length of at least one of the electrically conductive elements, and the distance between the electrically conductive elements. These geometric parameters can easily be modified by the circuit designer and may have a significant impact on the impedance of the antenna structure, thus being appropriate parameters for adjusting the same to an impedance of the integrated circuit.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

The illustration in the drawing is schematically. In different drawings, similar or identical elements are provided with the same reference signs.

DESCRIPTION OF EMBODIMENTS

Figure 1:
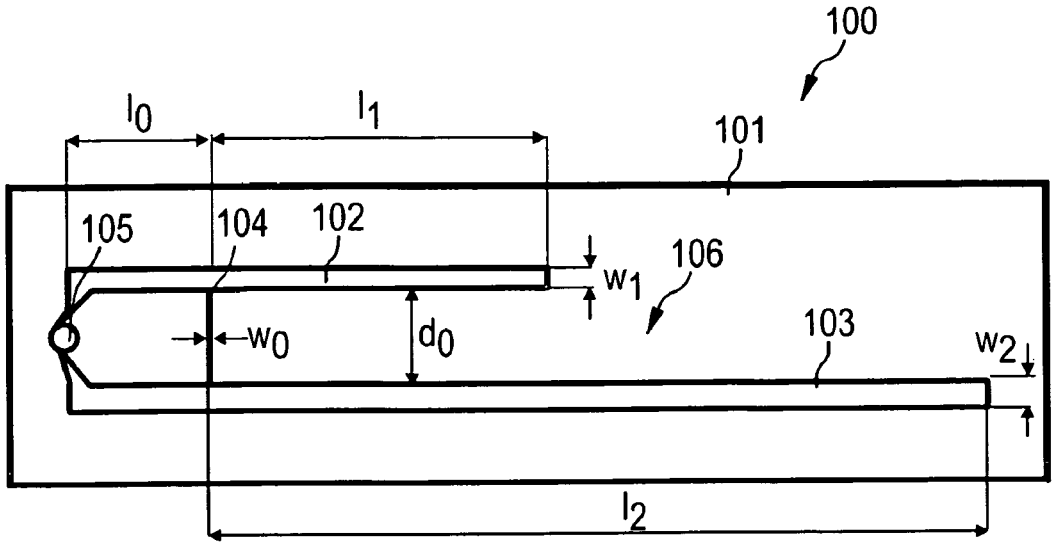
FIG. 1 shows a plan view of an RFID tag according to an exemplary embodiment of the invention.

In the following, referring to FIG. 1, an RFID tag 100 according to a first exemplary embodiment of the invention will be described. The RFID tag 100 comprises a plastic substrate 101, an antenna structure 106 arranged on the plastic substrate 101, and an integrated circuit (IC) 105.

The antenna structure 106 comprises a first electrically conductive element 102 having a first end and a second end. Further, a second electrically conductive element 103 is provided having a first end and a second end. The IC 105 is connected between the first end of the first electrically conductive element 102 and the first end of the second electrically conductive element 103 of the antenna structure 106. An ohmic short-circuiting element 104, that is to say a further electrical connection element, is provided for circuiting the first electrically conductive element 102 with the second electrically conductive element 103 and connects the electrically conductive elements 102, 103 at adjustable positions between their first and their second ends.

The integrated circuit 105 may be a silicon chip, that is to say an electronic chip made from a silicon wafer, the chip having an electrical circuit integrated therein. The integrated circuit 105 may have typical features of an integrated circuit of an RFID tag, like the capability of receiving and processing commands and to generate a response. Further, functions like a rectifying function may be provided by the integrated circuit 105.

As can be seen in FIG. 1, the second end of the first electrically conductive element 102 and the second end of the second electrically conductive element 103 are each disconnected. Further, the first electrically conductive element 102 and the second electrically conductive element 103 are realized as essentially stripe-shaped elements, which are arranged essentially parallel to one another. The two electrically conductive elements 102 and 103 have different lengths. The first electrically conductive element 102 has a length $l_0+l_1$, whereas the second electrically conductive element 103 has a length $l_0+l_2$. At a distance $l_0$ from the connection point to the integrated circuit 105, the ohmic short-circuiting element 104 is provided essentially perpendicular to the extension directions of the electrically conducting elements 102, 103 for circuiting the electrically conducting elements 102, 103. The width of the stripe-shaped first electrically conductive element 102 is denoted as $w_1$; wherein the width of the second electrically conductive element 103 is denoted as $w_2$. The width of the ohmic short-circuiting element 104 is denoted as $w_0$. The distance between the two stripe-shaped elements 102, 103 is denoted as $d_0$.

The material and the dimensions of the electrically conductive elements 102, 103 as well as the material of the plastics substrate 101 are configured such that the value of the impedance of the antenna structure 106 essentially equals the complex conjugate of the impedance of the integrated circuit 105, thus achieving a proper impedance matching.

The antenna structure 106 is formed from electrically conductive metallization elements (for instance made of copper, gold, silver, aluminium, etc., corresponding alloys or a superconducting material) which metallization elements are provided on the plastic substrate 101, the latter serving as a carrier material. Alternatively, the substrate 101 can be made from any ceramics, plastics with embedded ceramic particles, or the like, particularly having a value of the electric permittivity $\in_r \geqq 1$ and/or a value of the magnetic permittivity $\mu_r \geqq 1$. The metallization either can be deposited on the substrate 101 or can be embedded in the substrate 101 using an appropriate multilayer technique. The metallization can be realized by a conventional method like etching, milling, screen-processing, screen-printing, embossing or adhering techniques and may be deposited and patterned on the substrate 101.

The transponder 100 may be formed by connecting the first ends of the described antenna structure 106 to the RFID transponder semiconductor 105. This can be realized by conventional methods and techniques (like SMD, bonding, flip-chip, etc.).

FIG. 1 shows the antenna principle and the physical constitution. The metallic antenna structure 102, 103 is deposited on the carrier material 101, alternatively on a printed circuit board or the like. The semiconductor chip 105 is contacted at the corresponding antenna connections.

Figure 2:
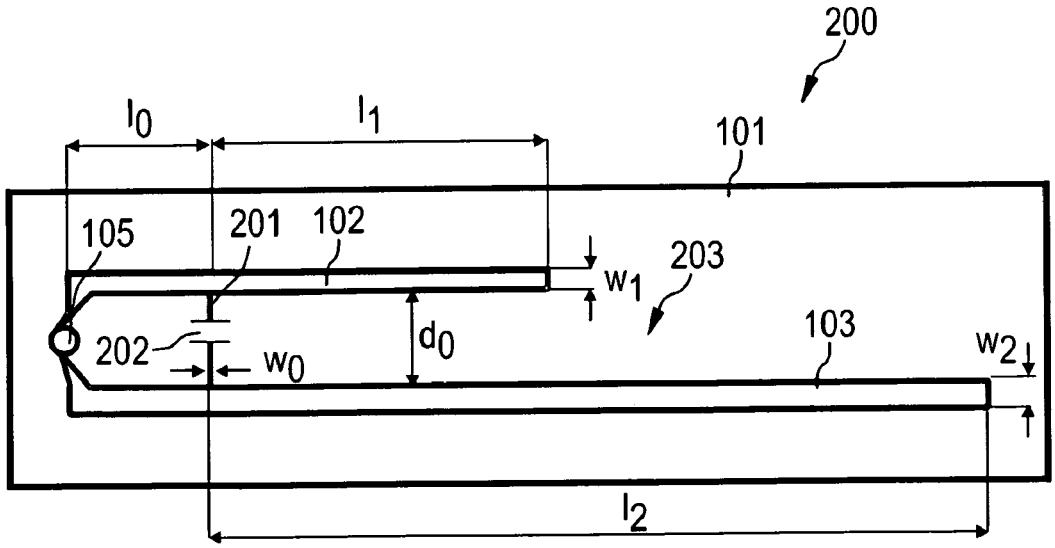
FIG. 2 shows a plan view of another RFID tag according to an exemplary embodiment of the invention.

In the following, referring to FIG. 2, an RFID tag 200 according to a second exemplary embodiment of the invention will be described. The main difference between the RFID tag 200 and RFID tag 100 is that the ohmic short-circuiting element 104 is replaced by a capacitor 202. The capacitor 202 is connected to the electrically conductive elements 102, 103 by means of a short-circuiting element 201, thereby forming an antenna structure 203. In contrast to an ohmic coupling, as in the case of FIG. 1, the configuration of FIG. 2 realizes a capacitive coupling of the two electrically conductive elements 102, 103. In other words, the structure 104 may be seen as a short-circuiting structure for DC current, wherein the structure 201, 202 shown in FIG. 2 may be seen as a short-circuiting structure for AC currents, particularly at sufficiently high-frequencies.

In the following, referring to FIG. 3, a diagram 300 will be described illustrating a broadband functionality of the RFID tag 100 shown in FIG. 1. Along an abscissa 301 of the diagram 300, the frequency is plotted in MHz. Along an ordinate 302, a scatter parameter $s_{11}$ in dB is plotted (see first curve 303) as well as an imaginary part $X_{ant}$ (see second curve 304) and a real part $R_{ant}$ (see third curve 305) of the input impedance $\underline{Z}_{ant}=R_{ant}+j*X_{ant}$ of the (optimized) broadband RFID antenna 106. The scatter parameter $s_{11}$ is a measure showing how proper a source (herein the antenna 106) is adapted to a drain (herein the chip 105). Mathematically it is defined as follows:

$$s_{11}=10\log(\mathrm{abs}((\underline{Z}_{chip}-\underline{Z}_{ant})/(\underline{Z}_{chip}+\underline{Z}_{ant}^*)))$$

wherein $\underline{Z}_{ant}^*$ is the complex conjugate of $\underline{Z}_{ant}$ and "abs" is the absolute value. The formula above is related to power whereas:

$$s_{11}=20\log(\mathrm{abs}((\underline{Z}_{chip}-\underline{Z}_{ant})/(\underline{Z}_{chip}+\underline{Z}_{ant}^*)))$$

is related to voltage and current.

Figure 3:
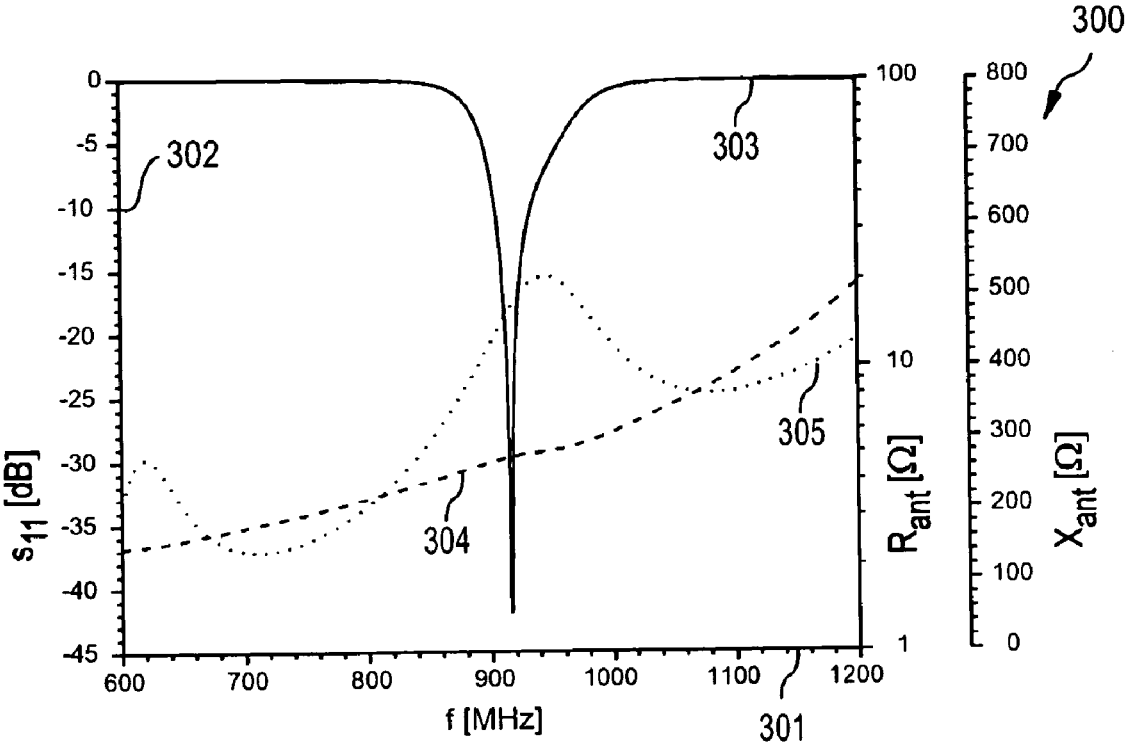
FIG. 3 shows a diagram illustrating a scatter parameter as well as a real and an imaginary part of the impedance of an optimized broadband RFID antenna according to an exemplary embodiment of the invention.

FIG. 3 now shows typical input parameters of a broadband RFID transponder. The antenna 106 is dimensioned in such a manner that it is matched to a given chip 105 impedance of approximately (15−j*270) Ω at a frequency of 915 MHz.

The "middle-frequency" of 915 MHz thus corresponds to the central or mid part of the American UHF band (902 MHz to 928 MHz). The broadband properties of the input impedance matching (reflected by the s-parameter) are caused by two single resonances being closely by one another. This can be seen from the asymmetric (related to the middle-frequency) resonance curve of the antenna, which in turn results from the slightly modified increase of the imaginary part of the antenna impedance in the region between 920 MHz and 960 MHz. The different intensity of the single resonances has its origin in the different matching, that is to say the lower resonance is stronger, since it is matched better. The upper resonance is much less pronounced.

Figure 4:
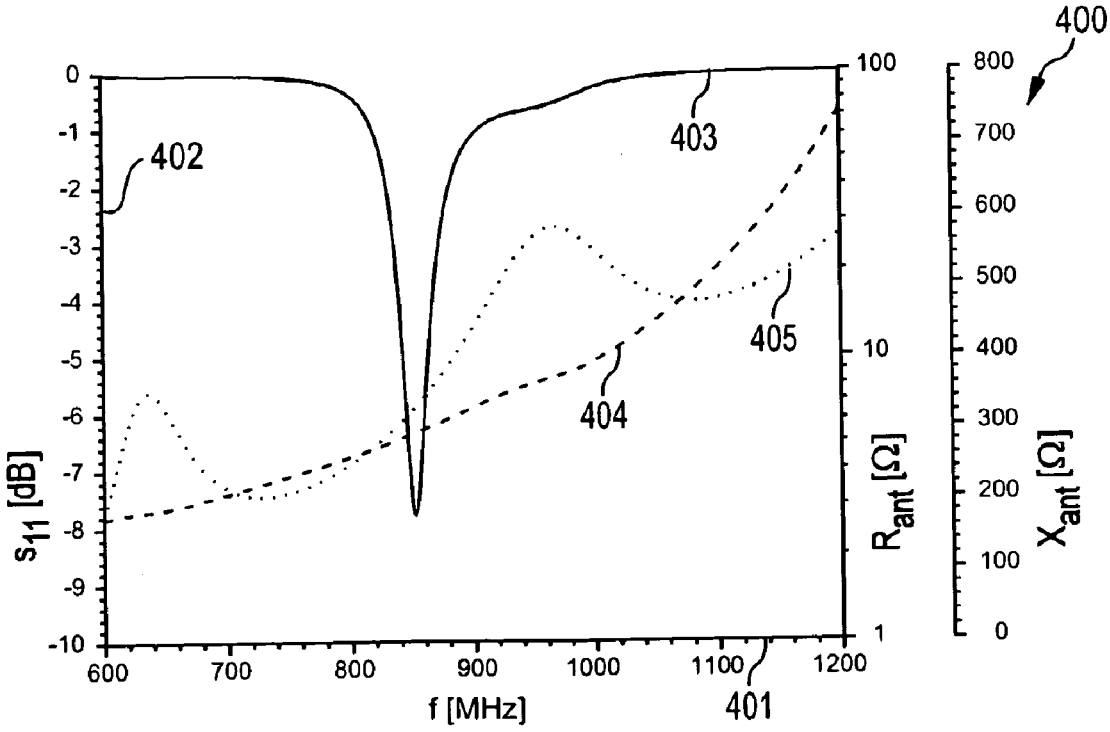
FIG. 4 illustrates a scatter parameter as well as a real and a imaginary part of the impedance of a non-optimized broadband RFID antenna.

In the following, referring to FIG. 4, a diagram 400 will be described illustrating a broadband functionality of a non-optimized antenna. Along an abscissa 401 of the diagram 400, the frequency is plotted in MHz. Along an ordinate 402, a scatter parameter $s_{11}$ is plotted in dB (see first curve 403) as well as an imaginary part $X_{ant}$ (see second curve 404) and a real part $R_{ant}$ (see third curve 405) of the input impedance $\underline{Z}_{ant}=R_{ant}+j*X_{ant}$ of the non-optimized antenna.

In the following, exemplary optimization parameters of the broadband RFID transponder 100 according to an exemplary embodiment of the invention will be described.

The geometric configuration of the antenna 106 according to an exemplary embodiment of the invention provides a plurality of parameters allowing to modify the behavior and/or to adapt the behavior of the antenna 106 to given conditions. Important aspects, which may be optimized, are:

- adaptation of the antenna 106 input impedance $\underline{Z}_{ant}$ to the output impedance of the transponder semiconductor $\underline{Z}_{chip}$, in order to reduce or minimize the reflection between these two members;
- maximization of the radiation efficiency of the antenna 106, and
- impedance matching the antenna 106 to the IC 105, which impedance matching should be as broadband as possible.

In the following, different parameters of the antenna design are discussed, and the effects of the variation of these parameters to the input behavior ($s_{11}$, $R_{ant}$, $X_{ant}$) are illustrated in order to allow a fast antenna adaptation.

As already mentioned, the antenna impedance is composed of two closely located single resonances, which are essentially caused by two parts of the electrically conductive elements 102, 103. The first resonance is caused by the section between chip 105 and short-circuiting element 104 (having approximately the length $2\ l_0+d_0$). The second resonance is caused by the section of the second electrically conductive element 103 between its free end and the short-circuiting element 104 (having the length $l_2$).

The matching of the antenna impedance $\underline{Z}_{ant}$ to the transponder chip impedance $\underline{Z}_{chip}$ may be realized by variation of the dimensions of the antenna 106. For the following parameter modifications, reference is made to FIG. 1. In other words, the parameters $l_0$, $w_0$, $d_0$, $l_1$, $w_1$, $l_2$ and $w_2$ are modified. Of course, apart from these parameters, a plurality of further antenna modifications may be realized, which may have an impact to the antenna characteristic as well. It is also possible to simultaneously modify particular parameter combinations, which may also have an influence of the antenna properties. Thus, the following description only refers to a selection of exemplary parameter modifications. The discussion mainly relates to some particularly characteristic parameters, which parameters allow that the different components of the antenna impedance $\underline{Z}_{ant}$ (real part $R_{ant}$ and imaginary part $X_{ant}$) may be modified simultaneously or separately from each other, in order to allow adaptation to a desired chip impedance.

Furthermore, the parameter modification may be limited to the two partial aspects related to the single resonances mentioned above. In this context, the structure causing the first resonance can also be considered as a special form of a folded dipole, and the structure causing the second resonance can be considered as a special form of a monopole antenna. The combination of these two antenna structures, combined with the coupling mechanism realized by the structure $l_1$, may have the result of a particular broadband resonance spectrum of the RFID antenna 106.

In the following, it will be described for the various parameters of the RFID tag 100, how the antenna structure 106 can be modified to obtain a matching of the antenna impedance $\underline{Z}_{ant}$ to the impedance $\underline{Z}_{chip}$ of the integrated circuit 105.

Next, the impact of a modification of the length $l_0$, that is to say the distance between the first end of the first electrically conductive element 102 and the position of the electrically conductive element 102 at which the ohmic short-circuiting element 104 is provided, will be described. The length $l_0$, may also be defined as the distance between the first end of the second electrically conductive element 103 and the position of the electrically conductive element 103 at which the ohmic short-circuiting element 104 is connected.

Figure 5:
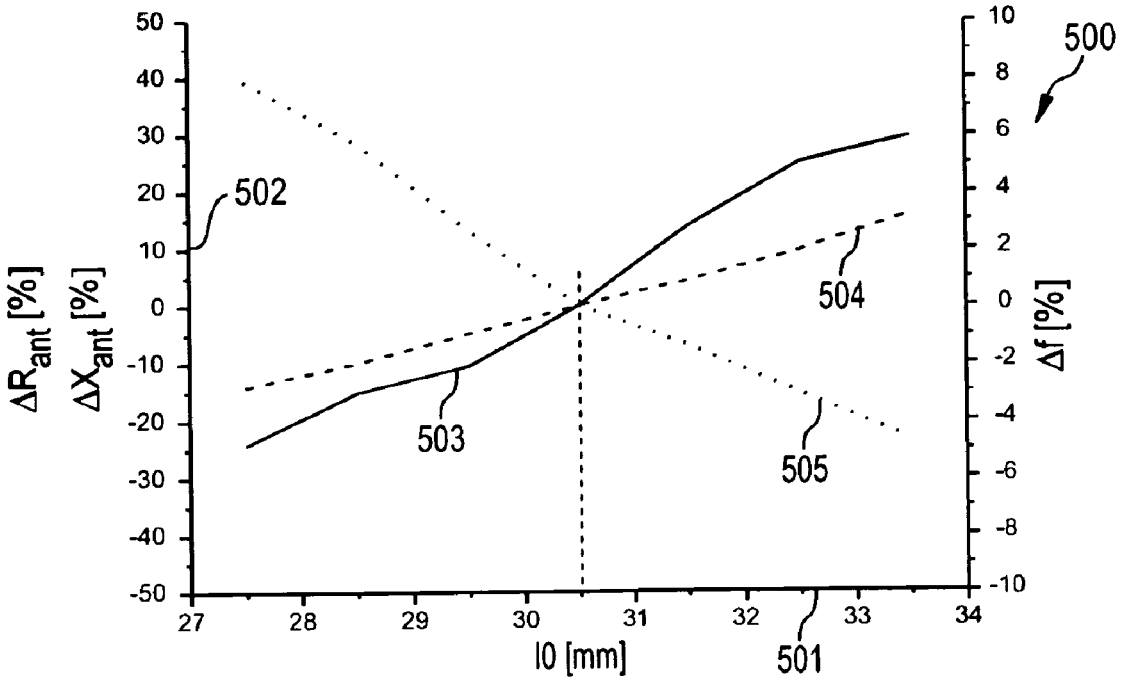
FIG. 5 illustrates the relative alteration of the impedance of the antenna, real part and imaginary part, as well as the relative shift of the middle-frequency as a function of the length between the first end of the first electrically conductive element and the position at which the first electrically conductive element is coupled to the coupling structure.

Assuming that all other parameters remain constant, the behavior of the antenna impedance $\underline{Z}_{ant}$ and the shift of the middle-frequency Δf is depicted in a diagram 500 shown in FIG. 5. Along an abscissa 501 of the diagram, the length $l_0$ is plotted in mm. Along an ordinate 502, the influence of a modification of the length $l_0$ concerning the shift of the middle-frequency Δf is plotted as well as the dependency on the modification of the real part $R_{ant}$ and the imaginary part $X_{ant}$ of the impedance $\underline{Z}_{ant}$. A first curve 503 plots the change of the real part $R_{ant}$, a second curve 504 shows the change of the imaginary part $X_{ant}$, and a third curve 505 illustrates the shift of the middle-frequency Δf.

As can be taken from FIG. 5, the real part $R_{ant}$ and the imaginary part $X_{ant}$ of the antenna impedance $\underline{Z}_{ant}$ are essentially proportionally dependent from the modification of the length $l_0$. The real part $R_{ant}$ shows a slightly stronger dependence than imaginary part $X_{ant}$.

A further parameter for modifying the antenna structure 106 is the distance $d_0$, that is to say the distance between the stripe-shaped conductors 102, 103. This parameter may have a strong influence on the capacitive coupling between parts of the metallization of the antenna structure 106. This coupling can thus be used to modify the antenna impedance $\underline{Z}_{ant}$ and to match the latter to the chip impedance $\underline{Z}_{chip}$. When the distance $d_0$ is reduced, the capacitive coupling between the first and second metallization structures 102, 103 of the antenna 106 is increased. This has the consequence that the imaginary part $X_{ant}$ of the complex antenna impedance $\underline{Z}_{ant}$ may become dominated by the capacitive properties in contrast to the inductive properties, thus the real part $R_{ant}$ becomes smaller. As a result of the change of $X_{ant}$, the middle-frequency may also be shifted as a function of $d_0$. Comparing the relative change of the imaginary part $X_{ant}$ and of the real part $R_{ant}$ of the antenna impedance $\underline{Z}_{ant}$, it may be recognized that the real part $R_{ant}$ is significantly more sensitive (for instance by a factor of two) with respect to changes in the distance than the imaginary part $X_{ant}$.

Figure 6:
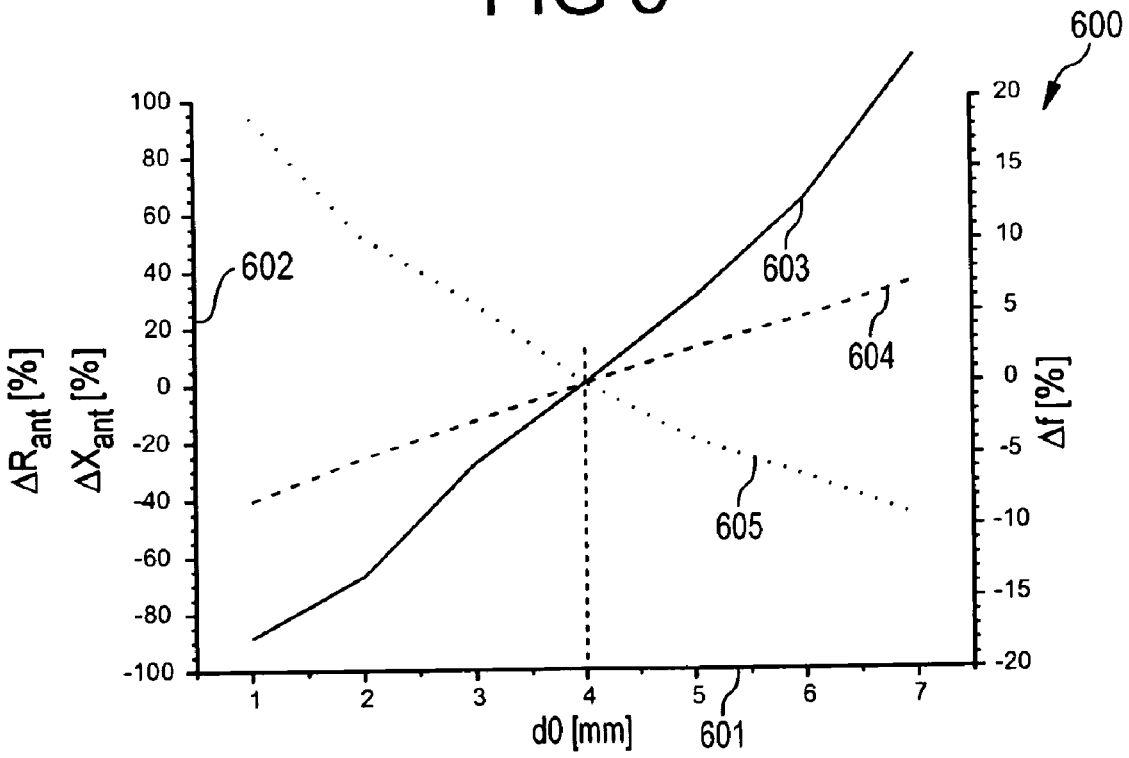
FIG. 6 illustrates the relative alteration of the impedance of the antenna, real part and imaginary part, as well as the relative shift of the middle-frequency as a function of a distance between two stripe-shaped electrically conductive elements.

The described behavior is illustrated in a diagram 600 shown in FIG. 6. Along an abscissa 601, the distance $d_0$ is plotted in mm, whereas the real part $R_{ant}$ and the imaginary part $X_{ant}$ of the antenna impedance $\underline{Z}_{ant}$ as well as the shift of the middle-frequency Δf are plotted along an ordinate 602 of the diagram 600. A first curve 603 is related to the real part $R_{ant}$ of the impedance $\underline{Z}_{ant}$, a second curve 604 is related to the imaginary part $X_{ant}$ of the impedance $\underline{Z}_{ant}$, and a third curve 605 is related to the shift of the middle-frequency Δf.

In contrast to the modification of the length $l_0$, the modification of the couple distance $d_0$ has the advantage that the real part $R_{ant}$ of the antenna impedance $\underline{Z}_{ant}$ can be influenced in a stronger manner.

Apart from the discussed adaptation of the couple distance $d_0$ constantly along the entire length of the opposing metal structures 102, 103 defined by the partial lengths $l_0$ and $l_1$, it may also be suitable to vary the couple distance along the extension $l_0$ and $l_1$ so that the distance $d_x$ may differ along the length $l_0+l_1$. For instance, a couple distance $d_1$ along the length $l_0$ can be different from a couple distance $d_2$ along the length $l_1$.

It is desirable to have a parameter which has a significant influence only to one antenna property but which does not influence the other properties. Such a parameter is the width $w_0$ of the short-circuiting structure 104 as will be discussed in the following.

When the width $w_0$ of this structure is modified, then this has a strong influence on the real part $R_{ant}$ of the antenna impedance $\underline{Z}_{ant}$. However, the imaginary part $X_{ant}$ of the antenna impedance $\underline{Z}_{ant}$ remains almost constant under such a modification.

Figure 7:
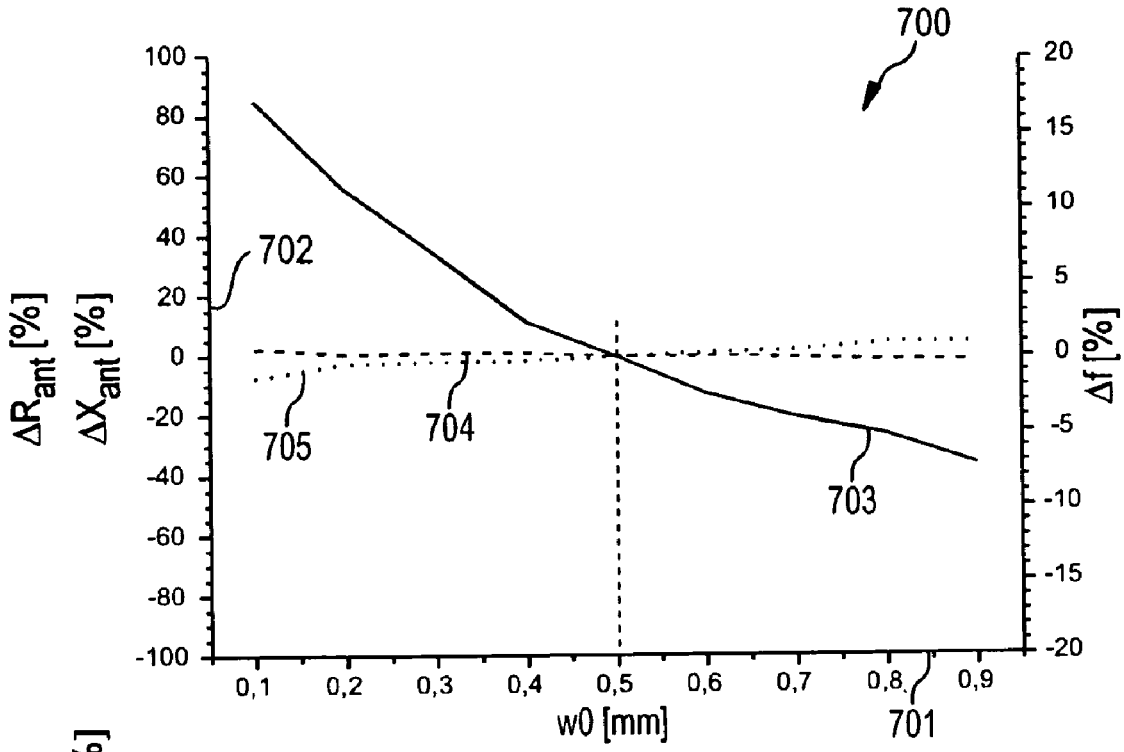
FIG. 7 illustrates a relative alteration of the impedance of the antenna, real part and imaginary part, as well as the relative shift of the middle-frequency as a function of the width of the coupling structure.

A corresponding graphical illustration is shown in FIG. 7. The diagram 700 plotted in FIG. 7 shows, along an abscissa 701, the width $w_0$ of the ohmic short-circuiting element 104 as a parameter. Along an ordinate 702, the real part $R_{ant}$ and the imaginary part $X_{ant}$ of the antenna impedance $\underline{Z}_{ant}$ is plotted as well as the shifts of the middle-frequency Δf. Particularly, a first curve 703 shows a strong influence on the real part $R_{ant}$ of the antenna impedance $\underline{Z}_{ant}$, wherein a second curve 704 illustrating the imaginary part $X_{ant}$ of the antenna impedance $\underline{Z}_{ant}$ and a third curve 705 illustrating a shift of the middle-frequency Δf show a relatively low influence and dependence on $w_0$.

Thus, the width $w_0$ of the ohmic short-circuiting element 104 gives an opportunity to selectively adjust only the real part $R_{ant}$ of the antenna impedance $\underline{Z}_{ant}$. In other words, a possible design optimization is the adaptation of the imaginary part $X_{ant}$ of the antenna impedance $\underline{Z}_{ant}$ by variation of the length $l_0$ and/or of the coupling distance $d_0$. In a further step, the real part $R_{ant}$ of the antenna impedance $\underline{Z}_{ant}$ can be adapted to the real part $R_{chip}$ of the chip impedance $\underline{Z}_{chip}$ by modification of the width $w_0$.

In the following, a parameter modification of the monopole will be discussed. An appropriate parameter for positioning the middle-frequency of the antenna is, apart from the length $l_0$, the length $l_2$. The influence of a modification of the length $l_2$ to the antenna input parameter as a function of the length $l_2$ is shown in FIG. 8.

Figure 8:
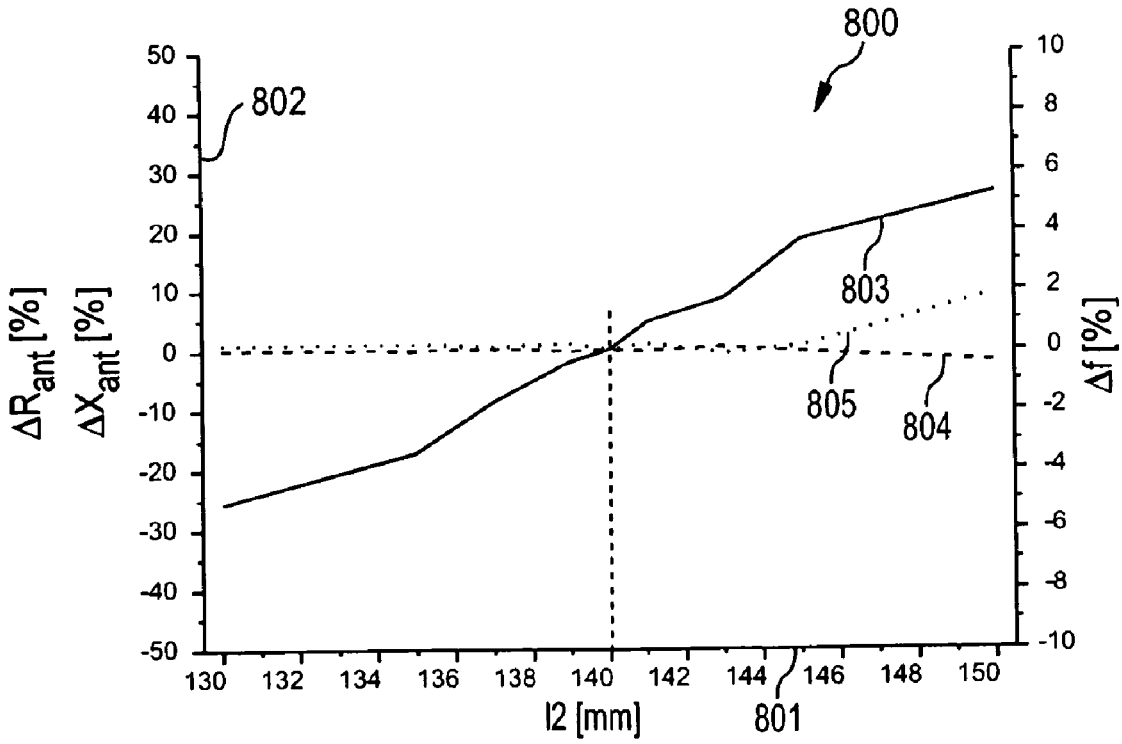
FIG. 8 illustrates the relative alteration of the antenna impedance, real part and imaginary part, as well as the relative shift of the middle-frequency as a function of the distance between the second end of the second electrically conductive element and the position at which the coupling structure connects the second electrically conductive element.

FIG. 8 illustrates a diagram 800 having an abscissa 801 along with the length $l_2$ in mm is plotted. Along an ordinate 802 of the diagram 800, the real part $R_{ant}$ and the imaginary part $X_{ant}$ of the antenna impedance $\underline{Z}_{ant}$ are plotted as well as the shift of the middle-frequency Δf. A first curve 803 shows the real part $R_{ant}$ of the impedance $\underline{Z}_{ant}$, a second curve 804 shows the imaginary part $X_{ant}$ of the impedance $\underline{Z}_{ant}$, and a third curve 805 shows the frequency shift Δf.

Modifying the fit parameter $l_2$ has, similar like the width $w_0$, the advantage that it is possible to selectively modify only the real part $R_{ant}$ of the impedance $\underline{Z}_{ant}$. As can be seen, the imaginary part $X_{ant}$ remains almost constant (up to a length $l_0 \approx 145$ mm). In contrast to the above-described behavior (modification of the width $w_0$), it can be recognized that the absolute change of the real part $R_{ant}$ (in the region between 130 mm$\leqq l_2 \leqq$150 mm) is essentially smaller, approximately by a factor of approximately two. This can be used for roughly adjusting the real part $R_{ant}$ by adjusting the width $w_0$. In a further step, a fine-tuning can be carried out by adjusting the length $l_2$.

In order to modify both parts ($R_{ant}$, $X_{ant}$) of the complex antenna impedance $\underline{Z}_{ant}$, the width $w_2$ of the monopole metallization can be adapted. When modifying this parameter, it should be taken into account that a modification has not been carried out symmetrically. In other words, when varying the width $w_2$, the distance $d_0$ is kept constant. This means that, by modifying the width $w_2$, the coupling between the electrically conductive elements 102, 103 as well as the length $l_1$ have not significantly been modified.

Figure 9:
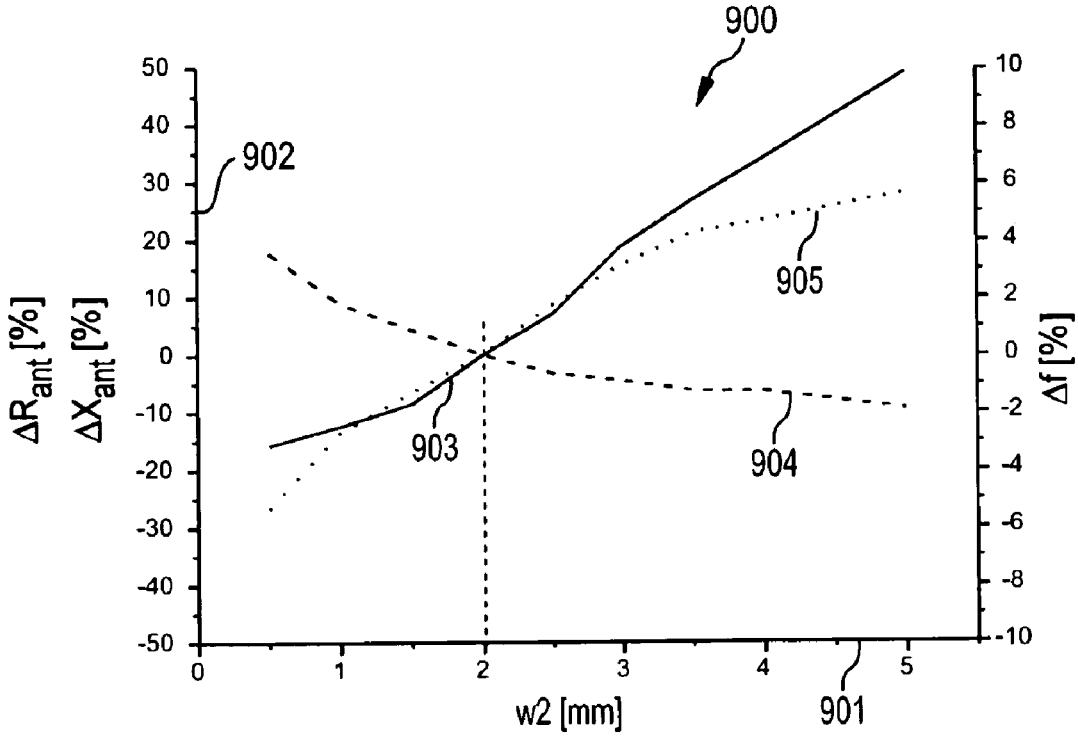
FIG. 9 illustrates the relative alteration of the impedance of the antenna, real part and imaginary part, as well as the relative shift of the middle-frequency as a function of the width of the stripe-shaped second electrically conductive element.

The diagram 900 shown in FIG. 9 shows the influence of a modification of the width $w_2$ to the antenna properties. Along an abscissa 901, the width $w_2$ is plotted in mm, whereas along an ordinate 902, the real part $R_{ant}$ and the imaginary part $X_{ant}$ of the antenna impedance $\underline{Z}_{ant}$ are plotted as well as the shift of the middle-frequency $\Delta f$. A first curve 903 is related to the real part $R_{ant}$ of the impedance $\underline{Z}_{ant}$, a second curve 904 is related to the imaginary part $X_{ant}$ of the impedance $\underline{Z}_{ant}$, and a third curve 905 is related to the shift of the middle-frequency $\Delta f$.

The real and the imaginary part show a reverse behavior. When the width $w_2$ increases, the real part $R_{ant}$ increases, whereas the imaginary part $X_{ant}$ of the impedance $\underline{Z}_{ant}$ decreases. This behavior (apart from the modifications already mentioned) thus may be used in order to realize the desired antenna impedance $\underline{Z}_{ant}$.

Next, parameter modifications of the coupling structure 104 will be discussed. As already mentioned, the capacitive coupling between parts of the metallization structures of the antenna can be used in order to match the antenna impedance $\underline{Z}_{ant}$ to the required chip impedance $\underline{Z}_{chip}$. The coupling of the monopole can, among others, be modified by the metallization parallel to the monopole. In this context, the length $l_1$ and the width $w_1$ are of particular importance.

Figure 10:
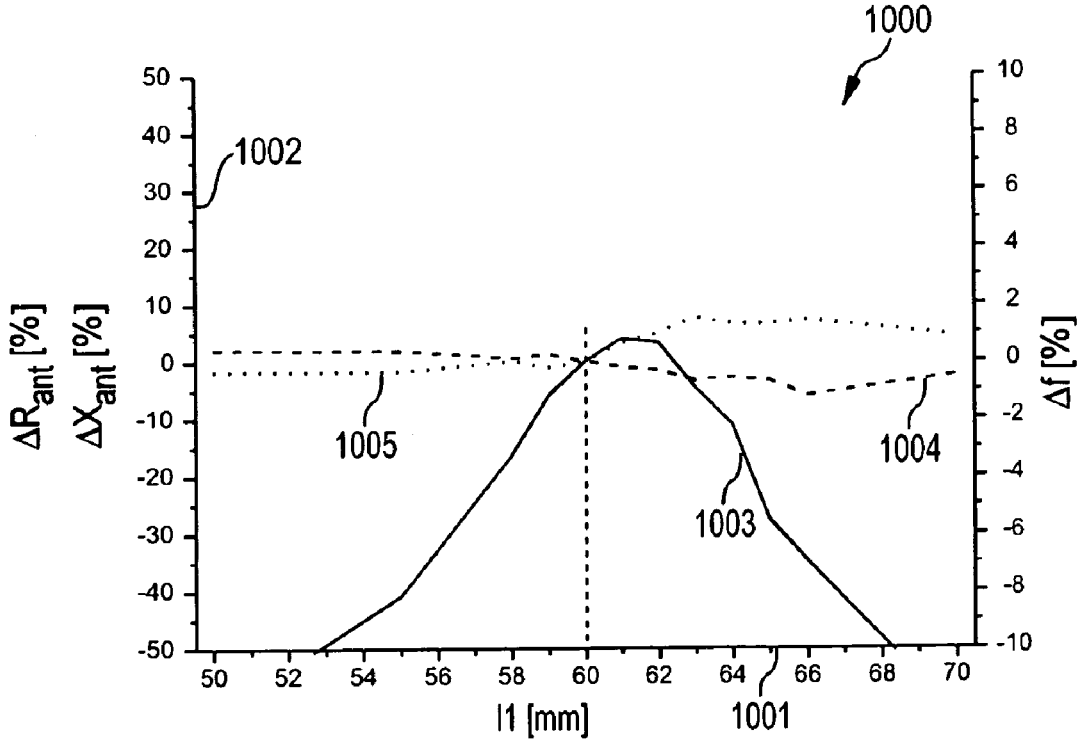
FIG. 10 illustrates the relative alteration of the impedance of the antenna, real part and imaginary part, as well as the relative shift of middle-frequency as a function of the length between the second end of the first electrically conductive element and the position at which the first electrically conductive element couples to the coupling structure.

Firstly, the influence of the length $l_1$ to the antenna impedance $\underline{Z}_{ant}$ will be discussed. A diagram 1000 shown in FIG. 10 shows the corresponding dependencies.

Diagram 1000 has an abscissa 1001 along which the length $l_1$ is plotted and having an ordinate 1002 along which the real part $R_{ant}$ and the imaginary part $X_{ant}$ of the antenna impedance $\underline{Z}_{ant}$ as well as the middle-frequency shift $\Delta f$ are plotted. As can be taken from diagram 1000, the imaginary part $X_{ant}$ remains almost constant, whereas the real part $R_{ant}$ is strongly dependent on the coupling length $l_1$. FIG. 10 shows a unique characteristics: when increasing the length $l_1$, the real part $R_{ant}$ increases up to a maximum and decreases again when the length $l_1$ is further increased. In order to have a relatively broadband matching, the length may be adjusted so that the operation state is close to the maximum of the curve 1003 in FIG. 10.

Secondly, the influence of a modification of the metallization width $w_1$ to the antenna properties is discussed. When modifying this parameter, it should be mentioned that a modification has not been carried out symmetrically. In other words, by variation of the width $w_2$, the distance $d_0$ is kept constant. This means, in turn, that a modification of the width $w_1$ does not significantly modify the coupling between the electrically conductive elements 102, 103 respectively the length $l_1$.

A diagram 1100 shown in FIG. 1I illustrates the corresponding behavior. Along an abscissa 1101, the width $w_1$ is plotted in mm, and along an ordinate 1102, the real part $R_{ant}$ and the imaginary part $X_{ant}$ of the antenna impedance $\underline{Z}_{ant}$ plotted as well as the shift of the middle-frequency $\Delta f$.

A first curve 1103 shows the behavior of the real part $R_{ant}$ and a second curve 1104 shows the behavior of the imaginary part $X_{ant}$ of the antenna impedance $\underline{Z}_{ant}$. A third curve 1105 shows the dependence of the middle-frequency shift $\Delta f$ from the width $w_1$.

Figure 11:
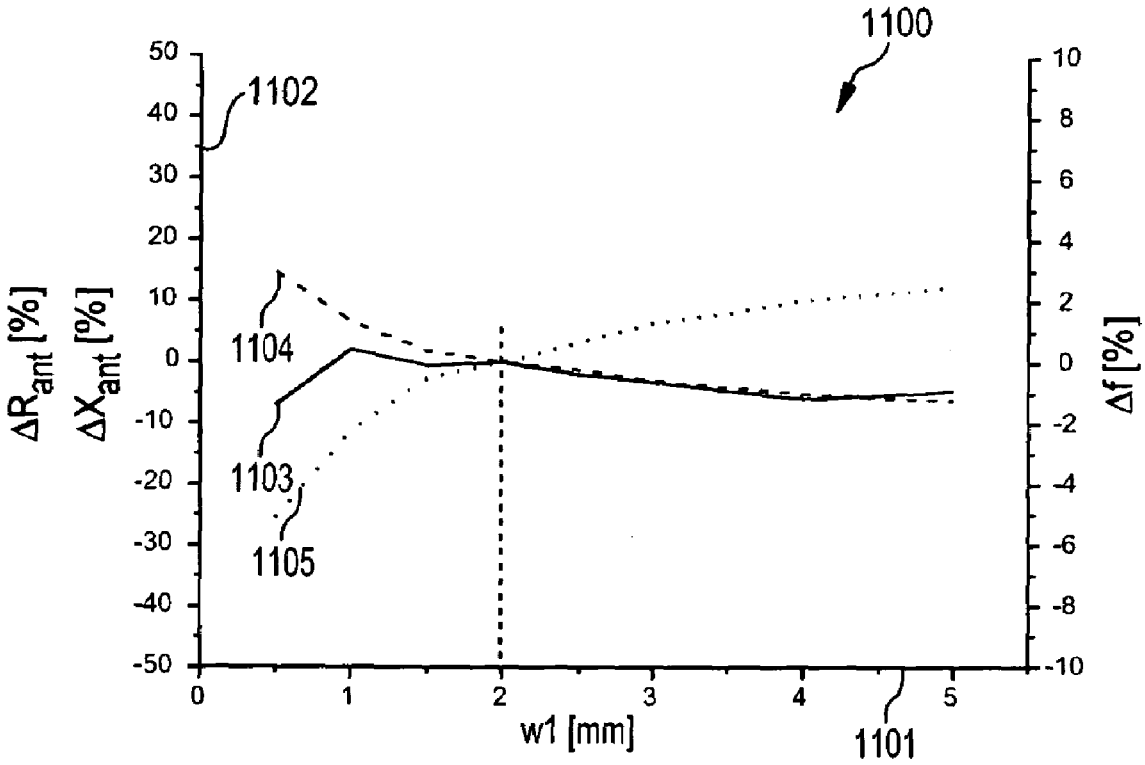
FIG. 11 illustrates the relative alteration of the impedance of the antenna, real part and imaginary part, as well as the relative shift of the middle-frequency as a function of the width of the stripe-shaped first electrically conductive element.

As can be seen in FIG. 11, the real part $R_{ant}$ and the imaginary part $X_{ant}$ show a different behavior at small widths. The relative modifications are inverse, meaning that the real part $R_{ant}$ increases, if the imaginary part $X_{ant}$ decreases. This occurs up to a width $w_1$ of approximately 2 mm. If the width $w_1$ is further increased, both curves show the same dependence and the corresponding values decrease.

In the following, further exemplary embodiments of the antenna design will be described. For instance, the system may be adapted to the employment of semiconductor elements which do not allow an ohmic short-circuiting 104. As a consequence of the internal structure (design) of transponder semiconductors, some ICs may not be connectable to an antenna structure comprising an electrical (DC) short-circuit (for instance a folded dipole or loop antenna). This results from the fact that such an electrical circuit might have a negative influence on the direct voltage supply of the semiconductor, and the transponder would not be able to work. In order to circumvent this problem, the ohmic short-circuit 104 of the antenna design of FIG. 1 can be replaced by a capacitive coupling, as shown in FIG. 2. This provides effectively a "short-circuit" for high-frequency signals (that is to say the coupling should be as large as possible), wherein the direct current parts can not pass such a capacitive coupling (that is to say have minimal losses and a very high isolation). This can be realized by different techniques. One possible technique is the replacement of the electrical ohmic short-circuit 104 by a capacitor 202, for instance an SMD member ("surface mounted device"). Alternatively, the electrical or ohmic short-circuit 104 can be replaced by a capacitive coupling structure, for instance by metallization structures arranged in a vertical or horizontal manner at a distance from one another.

Furthermore, it is possible to modify the coupling by using particular materials. As has been shown, by varying the electrical or capacitive coupling between parts of the metallic structure of the antenna, the impedance of the antenna $\underline{Z}_{ant}$ may be modified in order to match it to a given chip impedance $\underline{Z}_{chip}$ of the IC. This, among others, may be carried out by varying the distances between the metallization structures. Additionally or alternatively, the interspaces between the metallic coupling structures can be filled with a material having a value of the relative permittivity $\in_r > 1$, in order to improve the capacitive coupling. Further, parts of the coupling structures can be embedded in the carrier material so that the "efficient" value of $\in_r$ increases, since in this case the conductive material is embedded in the carrier material which has dielectric properties.

In the following, referring to FIG. 12 to FIG. 14, examples for the geometric configuration of metallization structures being arranged at a distance from one another in order to form a capacitive coupling structure will be described.

Figure 12:
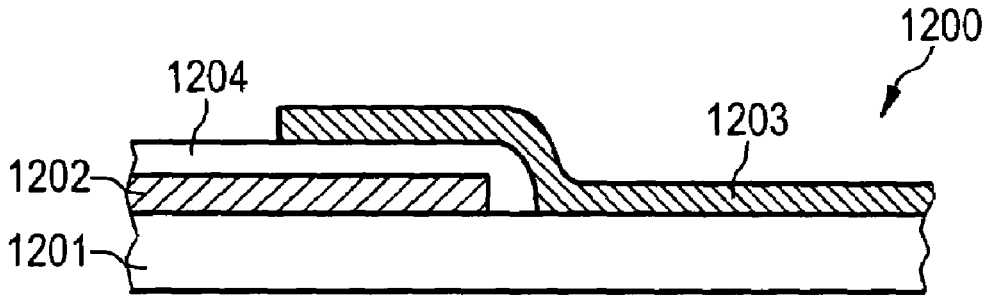
FIG. 12 shows a cross-sectional view of a coupling structure realized as a plurality of metallization structures arranged at a distance from one another in a vertical direction.

FIG. 12 shows a cross sectional view of a capacitive coupling structure 1200 of an antenna structure according to an embodiment of the invention, wherein a first metallization structure 1202 of the coupling structure is provided as a metallization layer deposited on a carrier substrate 1201. The first metallization structure 1202 is covered by a dielectric layer 1204 having a relatively high value of the permittivity $\in_r$, thus forming a protection layer for the first metallization structure and simultaneously providing a capacitor dielectric for a capacitor to be formed in the following. On a part of the dielectric layer 1204 and overlapping a part of the first metallization structure 1202, a second metallization structure 1203 is formed by depositing a layer of conductive material, thus completing a capacitor formed in the overlapping part of the layer sequence 1202 to 1204. According to FIG. 12, the first metallization structure 1202, the dielectric layer 1204 and the second metallization structure 1203 overlap in a vertical direction.

Next, referring to FIG. 13, a capacitive coupling structure 1300 of an antenna structure according to another embodiment of the invention will be described.

Figure 13:
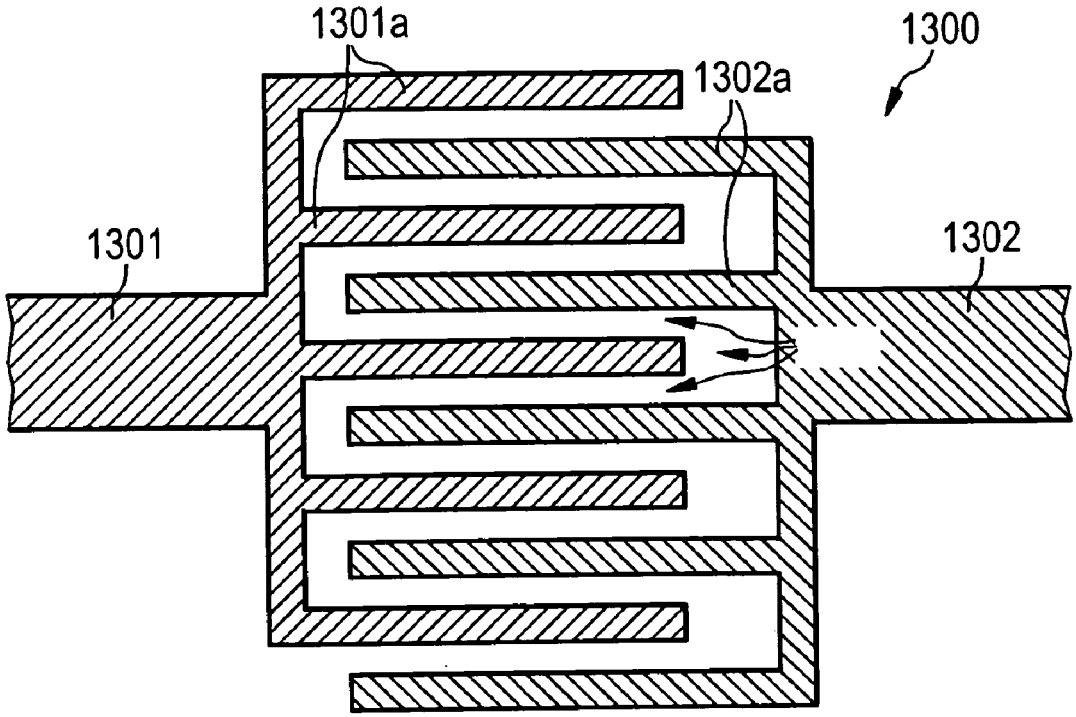
FIG. 13 shows a plan view of a coupling structure realized as a plurality of metallization structures arranged at a distance from one another in a horizontal direction.

In FIG. 13, a plan view of a capacitive coupling structure 1300 of an antenna structure according to another embodiment of the invention is shown. The capacitive coupling structure 1300 is constituted by a first metallization structure 1301 adjoining a second metallization structure 1302. In this adjoining portion, the first metallization structure 1301 has a plurality of first finger structures 1301*a*, and the second metallization structure 1302 has a plurality of second finger structures 1302*a*. The first finger structures 1301*a* and the second finger structures 1302*a* are arranged to form an interdigitated structure, such that a meander-like capacitive coupling portion 1303 is obtained. According to an alternative architecture of a meander-like capacitive coupling portion, the finger structures of the first and second metallization structures 1301 and 1302 may be provided in a manner that they are aligned along a vertical direction of FIG. 13 to form an interdigitated structure. According to this alternative meander configuration, the first and second metallization structures are essentially aligned along a horizontal direction of FIG. 13.

Figure 14:
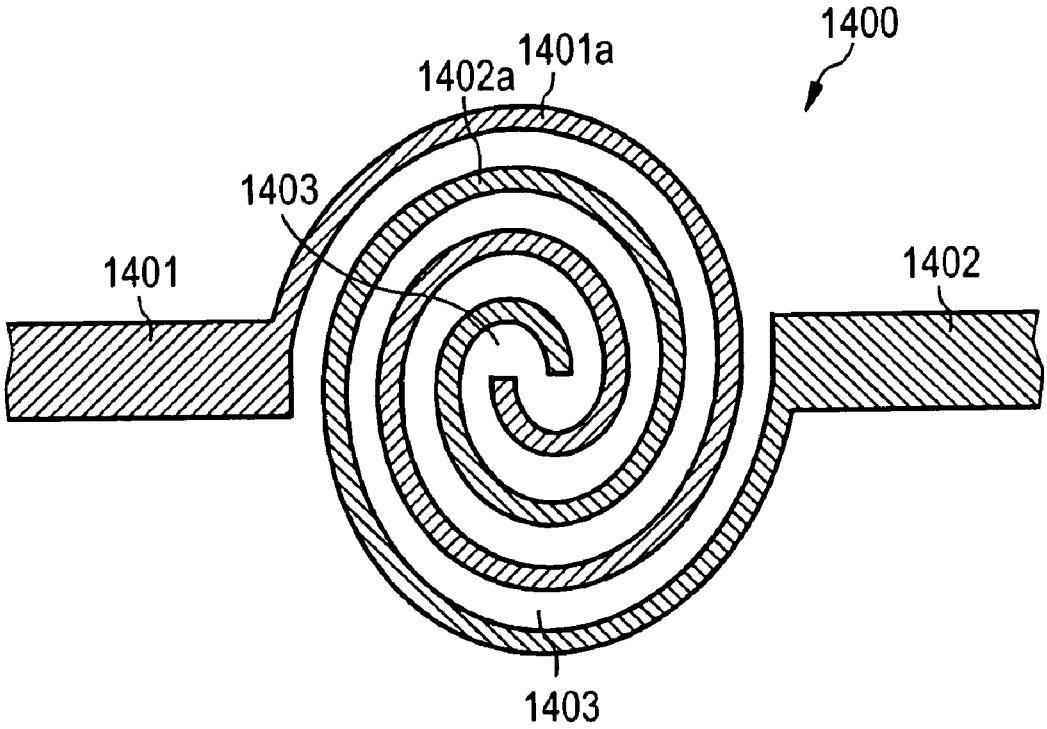
FIG. 14 illustrates a coupling structure realized as a plurality of metallization structures arranged at a distance from one another in a horizontal direction.

Referring to FIG. 14, a capacitive coupling structure 1400 of a folded dipole antenna according to another embodiment of the invention is described. As shown in the plan view of FIG. 14, the capacitive coupling structure 1400 has a first metallization structure 1401 and a second metallization structure 1402. The first metallization structure 1401 and the second metallization structure 1402 are forming a disconnected folded dipole antenna structure. At an end portion of the first metallization structure 1401, a first spiral structure 1401*a* is shown. Further, at an end portion of the second metallization structure 1402, a second spiral structure 1402*a* is shown. The first spiral structure 1401*a* and the second spiral structure 1402*a* are capacitively coupled in such a manner that a spiral-like capacitive coupling portion 1403 for capacitively coupling the first metallization structure 1401 to the second metallization structure 1402 is provided.

Finally, it should be noted that the term "comprising" does not exclude other elements or steps and the "a" or "an" does not exclude a plurality. In addition, elements described in association with different embodiments may be combined. It should also be noted that reference signs in the claims shall not be construed as limiting the scope of the claims.

The invention claimed is:

1. An antenna structure comprising:

a first electrically conductive element having a first end and a second end, a second electrically conductive element having a first end and a second end, a coupling structure coupling the first electrically conductive element with the second electrically conductive element by directly connecting the electrically conductive elements at positions between the first and the second ends, and wherein an integrated circuit is connectable between the first end of the first electrically conductive element and the first end of the second electrically conductive element.

2. The antenna structure according to claim 1, wherein the second end of the first electrically conductive element and the second end of the second electrically conductive element are disconnected.

3. The antenna structure according to claim 1, wherein the first electrically conductive element and the second electrically conductive element are realized as essentially stripe-shaped elements which are arranged essentially parallel to one another.

4. The antenna structure according to claim 3, wherein at least one of the parameters of the group consisting of the width of at least one of the electrically conductive elements and the coupling structure, the length of at least one of the electrically conductive elements, and the distance between the electrically conductive elements is/are chosen in such a way, that the value of the antenna impedance $\underline{Z}_{ant}$ of the antenna structure essentially equals the complex conjugate of the chip impedance $\underline{Z}_{chip}$ of the integrated circuit.

5. The antenna structure according to claim 1, wherein the first electrically conductive element and the second electrically conductive element are realized as essentially stripe-shaped elements have different lengths.

6. The antenna structure according to claim 1, wherein the coupling structure is adapted to ohmically couple the first electrically conductive element with the second electrically conductive element.

7. The antenna structure according to claim 1, wherein the material and/or the dimensions of the electrically conductive elements is/are configured in such a way, that the value of the antenna impedance $\underline{Z}_{ant}$ of the antenna structure essentially equals the complex conjugate of the chip impedance $\underline{Z}_{chip}$ of the integrated circuit.

8. The antenna structure according to claim 7, wherein the position at which the coupling structure connects the electrically conductive elements is configured in such a way, that the value of the antenna impedance $\underline{Z}_{ant}$ of the antenna structure essentially equals the complex conjugate of the chip impedance $\underline{Z}_{chip}$ of the integrated circuit.

9. The antenna structure according to claim 1, realized as a folded dipole antenna.

10. A transponder comprising:

a substrate, an antenna structure arranged on and/or in the substrate, the antenna structure including, a first electrically conductive element having a first end and a second end, a second electrically conductive element having a first end and a second end, a coupling structure couplilng the first electrically conductive element with the second electrically conductive element by directly connecting the electrically conductive elements at positions between the first and the second ends, and wherein an integrated circuit connected between the first end of the first electrically conductive element and the first end of the second electrically conductive element.

11. A method of manufacturing an antenna structure, the method comprising the steps of:

providing a first electrically conductive element having a first end and a second end, providing a second electrically conductive element having a first end and a second end, coupling the first electrically conductive element with the second electrically conductive element by directly connecting the electrically conductive elements at positions between the first and the second ends with a coupling structure, and adapting the electrically conductive elements in such a manner that an integrated circuit is connectable between the first end of the first electrically conductive element and the first end of the second electrically conductive element.

* * * * *